US009103142B2

(12) United States Patent
Abdollahzadeh et al.

(10) Patent No.: US 9,103,142 B2
(45) Date of Patent: Aug. 11, 2015

(54) MERCHANDISE DISPLAY SECURITY TETHER INCLUDING RELEASABLE ADHESIVE

(75) Inventors: Joshua Abdollahzadeh, Denver, NC (US); David N. Berglund, Charlotte, NC (US); Justin A. Richardson, Waxhaw, NC (US); Robert Schultz, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 296 days.

(21) Appl. No.: 13/401,008

(22) Filed: Feb. 21, 2012

(65) Prior Publication Data

US 2012/0217371 A1 Aug. 30, 2012

Related U.S. Application Data

(60) Provisional application No. 61/446,101, filed on Feb. 24, 2011.

(51) Int. Cl.

| | |
|---|---|
| ***G08B 13/12*** | (2006.01) |
| ***E05B 73/00*** | (2006.01) |
| ***G08B 13/14*** | (2006.01) |
| ***E05B 15/16*** | (2006.01) |

(52) U.S. Cl.

CPC ..... *E05B 73/0005* (2013.01); *E05B 15/1607* (2013.01); *G08B 13/1445* (2013.01); *G08B 13/1463* (2013.01); *E05B 73/0082* (2013.01)

(58) Field of Classification Search

CPC ..... G08B 13/1445; G08B 13/1463; E05B 15/1607; E05B 73/0005; E05B 73/0082

USPC ..... 248/551, 552, 205.3, 683; 70/58, 49, 70/14, 18; 340/568.1, 568.2

See application file for complete search history.

(56) References Cited

U.S. PATENT DOCUMENTS

| | | | | |
|---|---|---|---|---|
| 5,349,834 | A | 9/1994 | Davidge | |
| 5,699,591 | A | 12/1997 | Kane | |
| 5,709,110 | A * | 1/1998 | Greenfield et al. | 70/58 |
| 5,910,768 | A * | 6/1999 | Ott | 340/568.2 |
| 6,105,922 | A | 8/2000 | Derman | |

(Continued)

FOREIGN PATENT DOCUMENTS

WO 2011153651 A1 12/2011

OTHER PUBLICATIONS

Kim, Sang Woo, International Search Report, Sep. 19, 2012, pp. 1-5, Korean Intellectual Property Office, Republic of Korea.

*Primary Examiner* — Todd M Epps

(74) *Attorney, Agent, or Firm* — InVue Security Products Inc.

(57) ABSTRACT

A merchandise display security tether includes a mounting base, a releasable adhesive for releasably attaching the mounting base to an article of merchandise, and a housing configured to be positioned over the mounting base and a releasing portion of the releasable adhesive. The housing is secured to the mounting base by a tamper-proof fastener to prevent access to the releasing portion of the releasable adhesive. The security tether further includes a security cable having a first end attached to the housing and a second end for attachment to a merchandise display. The housing is removable by a special tool to expose the releasing portion of the releasable adhesive. The releasing portion is pulled to release the mounting base and the article of merchandise without damage to the merchandise and without leaving an adhesive residue on the merchandise.

28 Claims, 7 Drawing Sheets

(56) References Cited

U.S. PATENT DOCUMENTS

| | | | | |
|---|---|---|---|---|
| 6,196,857 | B1 * | 3/2001 | Fong | 439/304 |
| 6,389,853 | B1 * | 5/2002 | Pate et al. | 70/18 |
| 6,578,394 | B2 | 6/2003 | Yin | |
| 7,522,047 | B2 * | 4/2009 | Belden et al. | 340/568.1 |
| 7,971,845 | B2 * | 7/2011 | Galant | 248/551 |
| 2001/0028022 | A1 * | 10/2001 | Hamerski et al. | 248/205.3 |
| 2008/0197246 | A1 * | 8/2008 | Belden | 248/176.1 |
| 2009/0108151 | A1 * | 4/2009 | Carnevali | 248/205.3 |
| 2012/0032043 | A1 * | 2/2012 | McGreevy et al. | 248/205.3 |
| 2012/0120571 | A1 * | 5/2012 | Bisesti et al. | 361/679.01 |
| 2013/0169440 | A1 | 7/2013 | Brühwiler et al. | |

* cited by examiner

MERCHANDISE DISPLAY SECURITY TETHER INCLUDING RELEASABLE ADHESIVE

CROSS REFERENCE TO RELATED APPLICATION

This non-provisional application claims the benefits of U.S. Provisional Application No. 61/446,101, filed on Feb. 24, 2011, the disclosure of which is incorporated herein in its entirety.

FIELD OF THE INVENTION

This invention relates generally to merchandise display security devices for displaying and protecting an article of merchandise from theft. More particularly, the invention is a merchandise display security tether including a releasable adhesive for attaching the tether to an article of merchandise. In an exemplary embodiment, a merchandise display security tether includes a housing and at least one releasable adhesive strip, wherein the housing is configured to prevent access to a mounting base that is securely attached to the article of merchandise by means of the releasable adhesive strip. In another exemplary embodiment, a releasable adhesive permits a merchandise display security tether to be quickly and easily removed from an article of merchandise without causing damage to the merchandise and without leaving an adhesive residue on the merchandise that requires subsequent cleaning.

BACKGROUND OF THE INVENTION

Retailers routinely display articles of merchandise, such as portable computers (e.g. notebooks, laptops, tablets, etc.), e-readers, media players, and the like for customers to evaluate before making a purchase. These articles of merchandise are continually being made smaller and lighter in weight due to advances in technology and materials. As a result, such merchandise is increasingly vulnerable and susceptible to theft. At the same time, the retail price and profit margin for such merchandise continues to decline. Accordingly, these articles of merchandise need to be secured by a security device that effectively and cost efficiently protects the merchandise from theft.

Merchandise display security devices for displaying and protecting articles of merchandise attached to a mechanical tether are known. However, the known devices are not configured to be removed quickly and easily without causing damage to the article of merchandise and without leaving an adhesive residue on the merchandise that requires subsequent cleaning.

Known merchandise display security devices include a security tether consisting of a vinyl covered steel cable that is configured to attach at one end to an opening, recess or slot provided on a laptop computer. The other end of the tether is looped around a secure fixture, such as a bar, post, table leg or the like, or alternatively, is anchored, for example by a mechanical fastener, to a tabletop, counter, shelf or other display surface used in retail sales. It is also known to secure the other end of the tether to a mounting base that is in turn attached to the tabletop, counter, shelf or other display surface by means of a relatively strong adhesive.

A particular merchandise display security device configured to protect portable computers and like articles of merchandise is available from InVue Security Products Inc. of Charlotte, N.C., USA, and commercially known as the LTO Series 940 alarming module. The LTO Series 940 alarming module includes a tether having an anchor at one end and an alarm module at the other end. The anchor is configured to be quickly and easily anchored to a display surface, such as a tabletop, counter, shelf or the like used to conveniently display the portable article of merchandise for retail sales. The alarm module is configured to be quickly and easily attached to a relatively flat surface on the article of merchandise, for example to the rear surface of the display screen or video monitor of a laptop computer. The tether further includes a sense loop so that the alarm module will activate an alarm if the tether is cut, severed or decoupled from the anchor or the alarm module. The alarm module also activates the alarm if the anchor is removed from the display surface, or alternatively, if the alarm module is detached from the article of merchandise. The alarm module is typically attached to the article of merchandise by means of a relatively high-strength adhesive, for example a double-sided pressure sensitive adhesive (PSA), so that the alarm module remains attached to the article of merchandise during an attempted theft and continues to alert store personnel to the location of the merchandise. As a result, it is nearly impossible to remove the alarm module from the article of merchandise without damaging the merchandise and without rendering the merchandise unsuitable for sale as a result of the adhesive residue that remains on the article when the alarm module is detached from the merchandise.

Accordingly, there exists a need for an improved merchandise display security device for protecting an article of merchandise from theft. There exists a further and more specific need for a merchandise display security tether including a releasable adhesive for attaching the tether to an article of merchandise. There exists another further and more specific need for a merchandise display security tether including a housing and at least one releasable adhesive strip, wherein the housing is configured to prevent access to a mounting base that is securely attached to the article of merchandise by means of the releasable adhesive strip. There exists yet another further and more specific need for a releasable adhesive that permits a merchandise display security tether to be quickly and easily removed from an article of merchandise without causing damage to the merchandise and without leaving an adhesive residue on the merchandise that requires subsequent cleaning.

DETAILED DESCRIPTION OF EXEMPLARY EMBODIMENTS OF THE INVENTION

Figure 1:
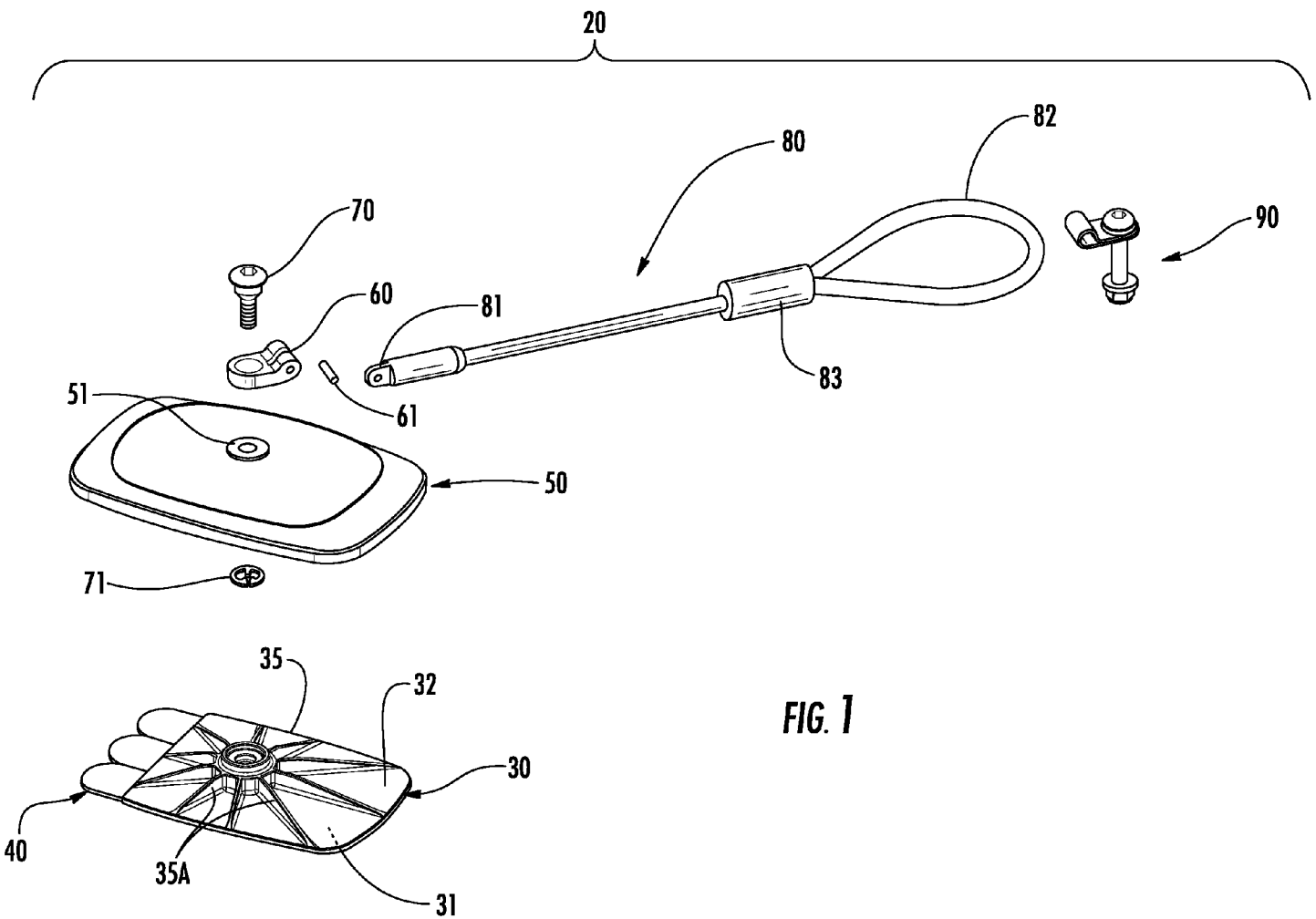
FIG. 1 is an exploded perspective view of an exemplary embodiment of a merchandise display security tether for displaying and protecting an article of merchandise according to the present invention.

Referring now to the accompanying drawing figures wherein like reference numerals denote like elements throughout the various views, one or more exemplary embodiments of a merchandise display security device for displaying and protecting an article of merchandise from theft are shown. More particularly, the drawing figures show exemplary embodiments of a merchandise display security tether, indicated generally by reference character 20, for being attached to an article of merchandise, indicated generally by reference character M in FIG. 4. As shown and described herein, the merchandise display security tether 20 includes a housing 50 configured to prevent access to a mounting base 30 that is releasably attached to the article of merchandise M by a releasable adhesive strip assembly 40. The adhesive strip assembly 40 readily releases the mounting base 30 from the article of merchandise M in the event that the merchandise is to be removed from a retail sales display, for example to be sold. A particular feature of the present invention is that the merchandise display security tether 20 displays and protects an article of merchandise M from unauthorized removal or theft from a retail sales display, yet can be readily (i.e. quickly and easily) removed from the merchandise. Another feature of the present invention is that the mounting base 30 of the merchandise display security tether 20 is attached to the article of merchandise M by a releasable adhesive strip assembly 40 so that the mounting base can be detached without causing damage to the merchandise and without leaving an adhesive residue on the merchandise that requires subsequent cleaning. Still another feature of the present invention is that the housing 50 is removably secured on the mounting base 30 by a tamper-proof fastener. Accordingly, an article of merchandise M attached to the mounting base 30 of the merchandise display security tether 20 can be moved from one display location to another by removing the housing 50 from the mounting base without the need to detach the merchandise from the mounting base.

FIG. 1 shows an exemplary embodiment of a merchandise display security tether 20 according to the invention for displaying and protecting an article of merchandise M from unauthorized removal or theft from a display, for example, in a retail store. The article of merchandise M is typically a display model or an operational sample of electronic merchandise, such as portable computers (e.g. notebooks, laptops, tablets, etc.), e-readers, media players and the like, for a customer to examine before making a decision to purchase the item. The article of merchandise M is attached to the merchandise display security tether 20 in a manner that permits a prospective purchaser to evaluate the operation and features of the merchandise, while protecting the merchandise from a potential thief. In the exemplary embodiment shown in FIG. 4, the article of merchandise M is a conventional laptop computer having a display screen S, and the mounting base 30 (disposed within removable housing 50) is attached to the rear surface of the display screen.

Figure 2:
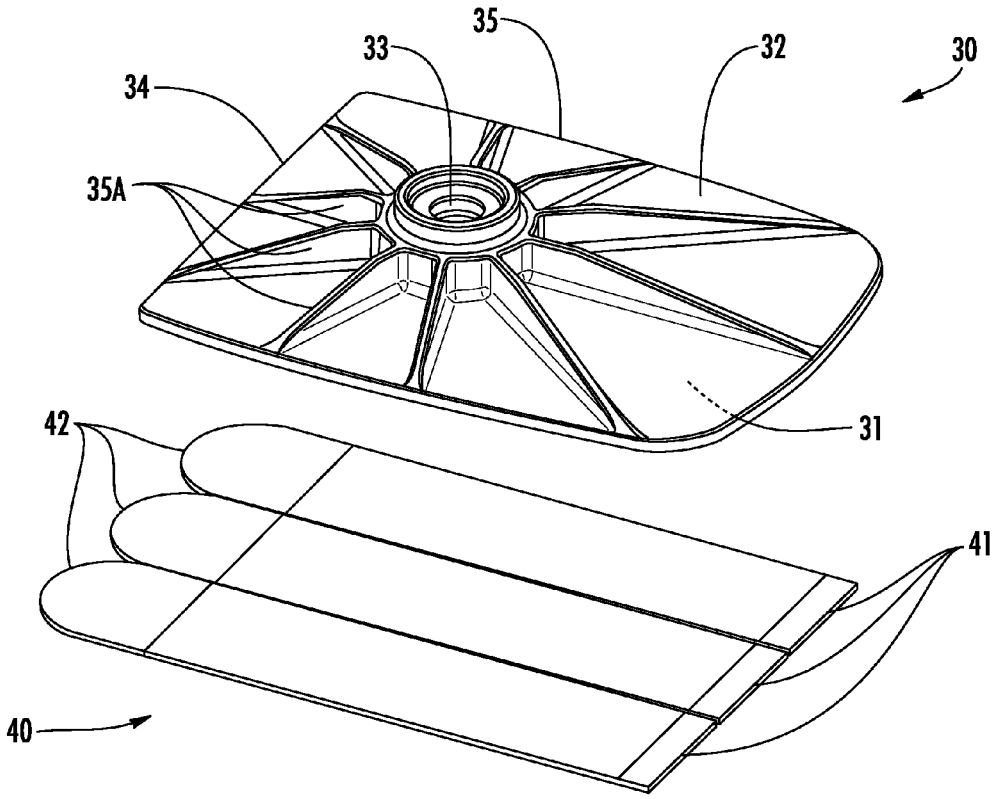
FIG. 2 is an exploded perspective view of an exemplary embodiment of a mounting base and an adhesive strip assembly of the merchandise display security tether of FIG. 1.

As best shown in FIG. 2, the merchandise display security tether 20 includes the mounting base 30 and the releasable adhesive strip assembly 40 for attaching the mounting base to an article of merchandise. The mounting base 30 comprises a relatively thin, yet substantially rigid body 35 having a generally planar and flat first surface 31 configured (sized and shaped) to receive the releasable adhesive strip assembly 40. An opposite second surface 32 of the mounting base 30 is stiffened by means of a plurality of integrally-formed ribs 35A that extend radially from a threaded insert 33 configured to receive a mating tamper-proof security fastener 70 (FIG. 1). The adhesive strip assembly 40 comprises at least one, and preferably, a plurality of double-sided pressure sensitive adhesive (PSA) strips 41 adapted to be pressed into firm engagement with the first surface 31 of mounting base 30. Suitable PSA strips 41 are available from 3M Company of St. Paul, Minn., USA, and are commercially known as COMMAND™ Mounting Strips. However, any double-sided pressure sensitive adhesive (PSA) capable of being adhered to and readily removed from the article of merchandise M without leaving an adhesive residue is suitable for use with the present invention.

Figure 4:
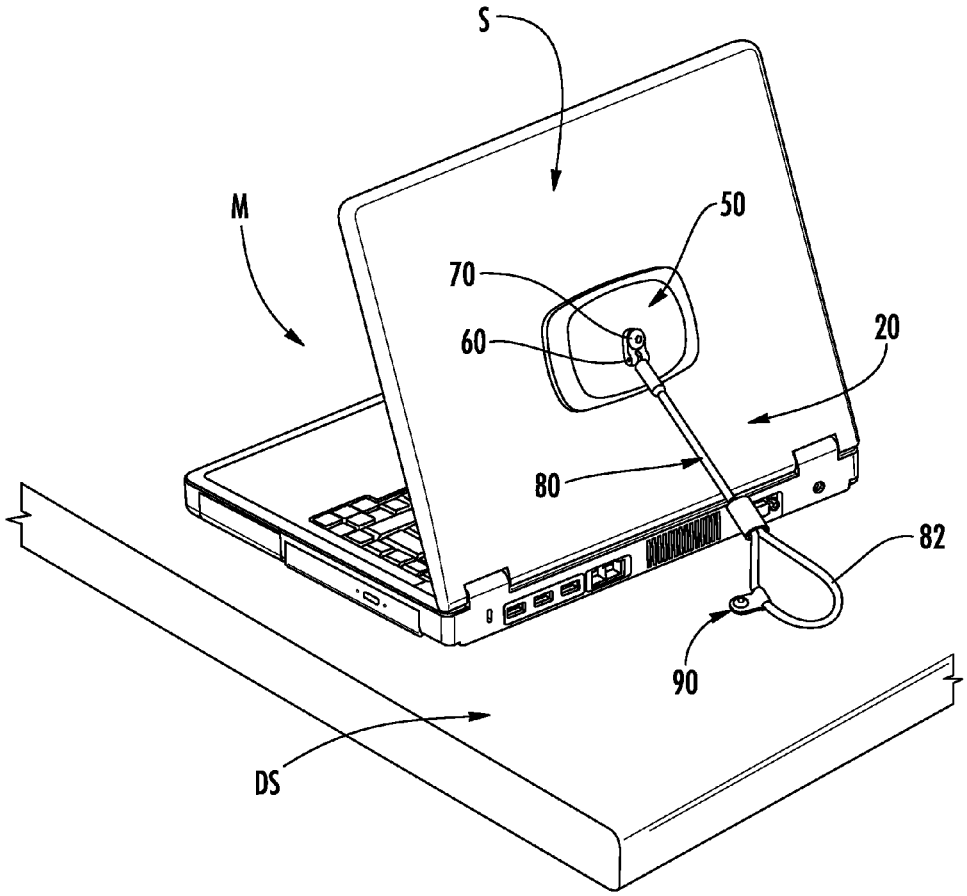
FIG. 4 is a perspective view of the merchandise display security tether of FIG. 1 shown with the mounting base attached to an article of merchandise and the anchor assembly secured to a display surface.

Each PSA strip 41 is generally planar and has pressure sensitive adhesive disposed on both of its opposing flat surfaces. One generally planar flat surface of the PSA strip 41 adheres to first surface 31 of mounting base 30 and the other generally planar flat surface adheres to a relatively flat surface of the article of merchandise M, such as the rear surface of the display screen S of a laptop computer, as illustrated in FIG. 4. Each PSA strip 41 comprises a releasing tab 42 at one end that is free of adhesive and extends outwardly beyond an edge 34 of the mounting base 30 when the strip is adhered to the first surface 31. In use, one or more PSA strips 41 are secured to first surface 31 of mounting base 30 and thereafter the mounting base and releasable adhesive strip assembly 40 are together firmly pressed onto a generally flat surface of the article of merchandise M at a desired location, for example the rear surface of the display screen S of a laptop computer, as illustrated in FIG. 4. The housing 50 of the merchandise display security tether 20 is generally dome-shaped to extend over and entirely cover the mounting base 30 and adhesive strip assembly 40. Housing 50 has hole 51 formed therethrough for receiving the security fastener 70. Security fastener 70 is tightened using a tool having a proprietary shaped tip to engage threaded insert 33 of the mounting base 30, and thereby secure the housing 50 over the mounting base 30 and the adhesive strip assembly 40. As will be understood and appreciated by those skilled in the art, security fastener 70 cannot be easily removed without using the tool having a proprietary shaped tip. Consequently, housing 50 prevents unauthorized access to the mounting base 30, and in particular, to releasing tabs 42 of PSA strips 41.

More particularly, merchandise display security tether 20 comprises mounting base 30 for receiving adhesive strip assembly 40 thereon to securely attach the mounting base to the article of merchandise M. Housing 50 is configured (sized and shaped) to be received on mounting base 30 in a manner that prevents access to the mounting base and the adhesive strip assembly 40 adhered to the surface 31 of the mounting base. As shown in FIG. 1, security fastener 70 retains the housing 50 on the mounting base 30 via a lock washer 71 disposed between the mounting base and the housing. A clevis 60 is movably disposed between the housing 50 and the head of the security fastener 70 to receive a security cable 80 for a purpose to be further described hereafter. In an exemplary embodiment, the security cable 80 comprises an eyelet attachment 81 at one end and an expansion pin 61 is inserted through clevis 60 and eyelet attachment 81 to securely attach security cable 80 to clevis 60. The clevis 60 is preferably attached to housing 50 by security fastener 70 via a smooth swivel coupling so that the security cable is rotatable relative to the housing.

Security cable 80 may, for example, consist of a generally flexible, yet relatively inelastic, steel cable jacketed with a protective vinyl covering. The end of the security cable 80 opposite the eyelet attachment 81 is permanently formed into a cable loop 82 by a crimped ferrule 83. Cable loop 82 is dimensioned sufficiently large to receive housing 50 therethrough so that the security cable 80 can be looped around a secure bar, pipe, post, table leg, or the like, in a manner to be described with reference to FIGS. 5A-5H. Alternatively, the security cable 80 may be secured via cable loop 82 directly to a tabletop, counter, shelf or other display surface used in retail sales using an anchor assembly 90 (FIG. 1). Regardless of the method of securing the merchandise display security tether 20 to the retail sales display, security cable 80 has a length sufficient to allow a customer to evaluate the operation and features of the article of merchandise M including, for example, determining the weight of a laptop computer and opening and closing the display screen S of the laptop computer, when making a decision whether to purchase the merchandise.

Figure 3:
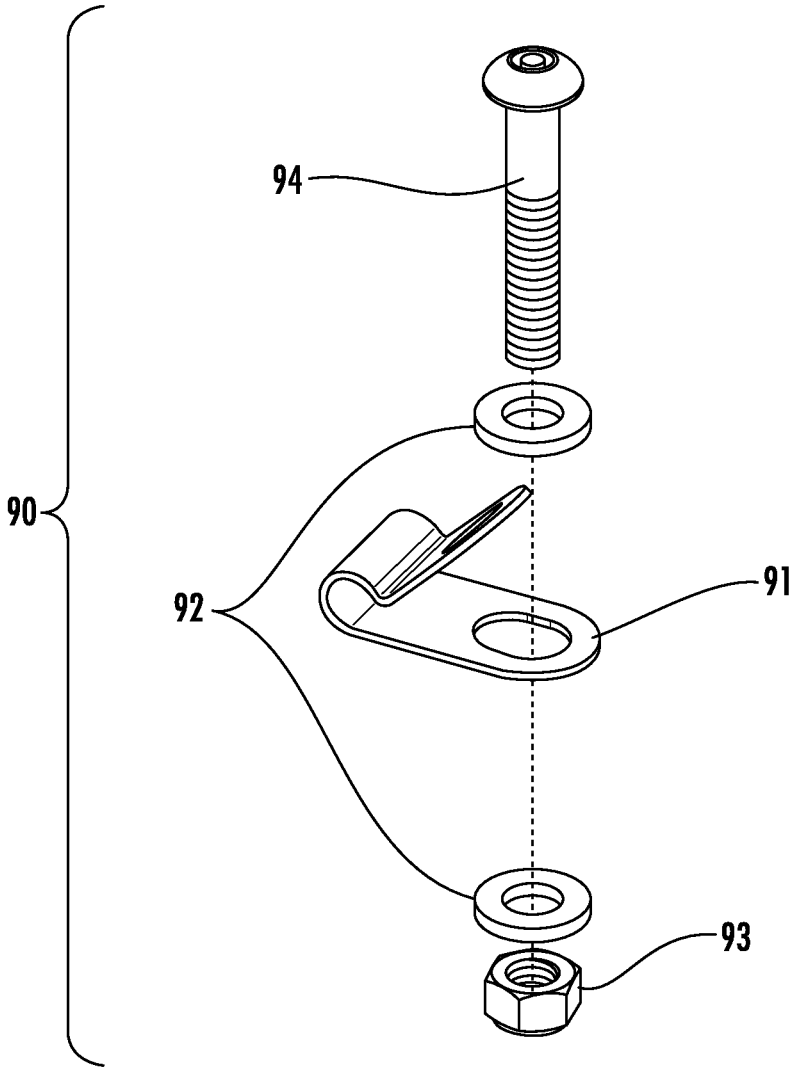
FIG. 3 is an exploded perspective view of an exemplary embodiment of an anchor assembly of the merchandise display security tether of FIG. 1.

As shown in FIG. 4, anchor assembly 90 is provided to permit a retailer to attach the article of merchandise M via the cable loop 82 of security cable 80 directly to a retail sales display surface DS, such as a tabletop, shelf or counter. An exemplary embodiment of an anchor assembly 90 suitable for use with a merchandise display security tether 20 according to the present invention is shown in FIG. 3. Anchor assembly 90 comprises an Adel clamp 91, upper and lower washers 92 disposed on either side of the Adel clamp, lock nut 93 and security fastener 94. The length of the security fastener 94 is preferably sized to accommodate tabletops, shelves and counters of various thicknesses up to about 0.75 inches. As previously described with respect to security fastener 70, security fastener 94 requires the use of a tool having a proprietary shaped tip to prevent unauthorized removal of security fastener 94 from display surface DS.

Figure 5A:
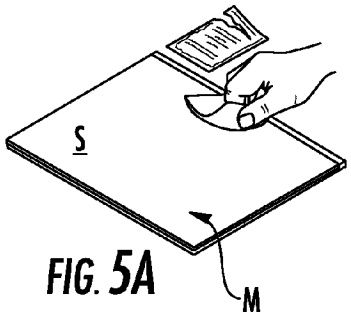
FIGS. 5A-5H are series perspective views illustrating an exemplary embodiment of a first method for displaying and protecting an article of merchandise using the merchandise display security tether of FIG. 1.
Figure 5B:
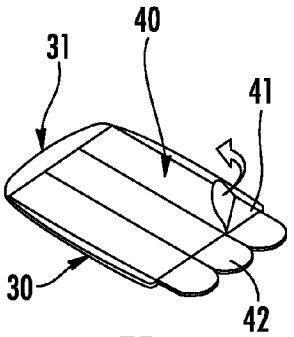
Figure 5C:
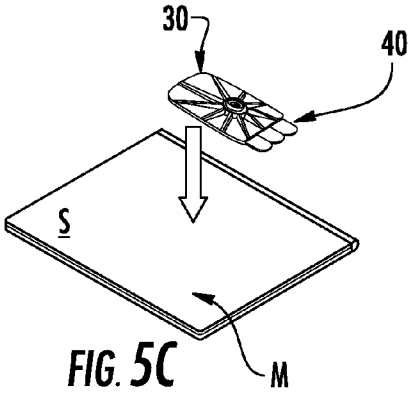
Figure 5D:
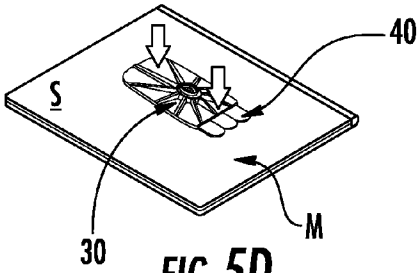
Figure 5E:
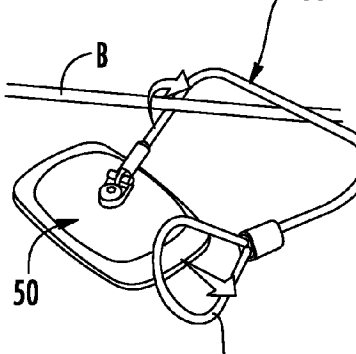
Figure 5F:
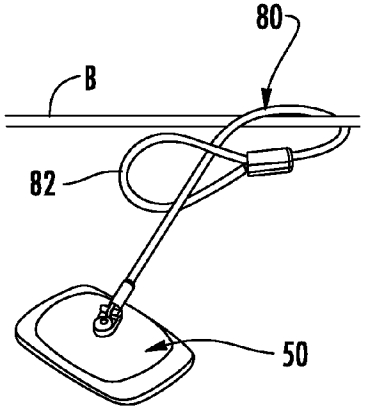
Figure 5G:
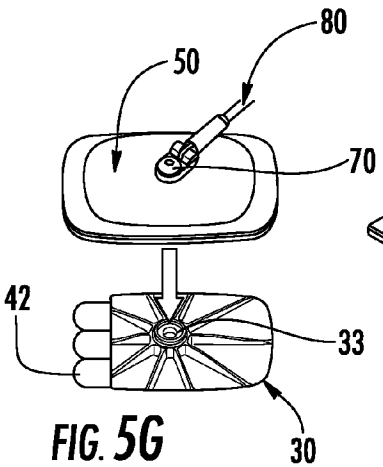
Figure 5H:
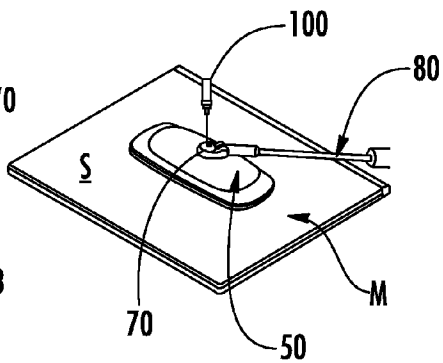

The series perspective views FIGS. 5A-5H illustrate an exemplary embodiment of a first method for displaying and protecting an article of merchandise using the merchandise display security tether of FIG. 1. In the illustrated embodiment, the security cable 80 of the merchandise display security tether 20 is used to attach the article of merchandise M to a secure bar B, such as a pipe, post, table leg, or the like. As shown in FIG. 5A, a relatively flat surface S of an article of merchandise M, for example the display screen of the laptop computer shown in FIG. 4, is first prepared for receiving the adhesive strip assembly 40 by cleaning the surface with an alcohol pad. As previously described, one side of the adhesive strip assembly 40 is pressed into firm engagement with the first surface 31 of mounting base 30. As shown in FIG. 5B, release paper covering the PSA strips 41 is then removed to expose the adhesive on the other side of the strips so that the combination mounting base 30 and adhesive strip assembly 40 may be firmly pressed against the surface S of the article of merchandise M at a desired location in the manner illustrated in FIGS. 5C and 5D. As illustrated in FIGS. 5E and 5F, housing 50 is connected to the security cable 80 as previously described and then passed through the cable loop 82 with the security cable looped (i.e. wrapped) around the bar B of the display. As illustrated in FIGS. 5G and 5H, housing 50 is next positioned over the mounting base 30 affixed to the surface S of the merchandise M to simultaneously cover the combination mounting base 30 and adhesive strip assembly 40. The special tool having proprietary shaped tip 100 is used to engage the tamper-proof security fastener 70 and thereby secure housing 50 to the threaded insert 33 of the mounting base 30. The article of merchandise M may then be positioned in the desired display orientation to be examined and operated by a customer. As previously mentioned, security fastener 70 prevents an unauthorized person from removing the housing 50 from mounting base 30 and thereby gaining access to the releasing tabs 42 (FIG. 5G) of PSA strips 41. At the same time, security fastener 70 permits an authorized person to remove the housing 50 from the mounting base 30 for the purpose of relocating the article of merchandise M to another security cable 80 and housing 50 elsewhere on the display without the need to detach the merchandise from the mounting base.

Figures 6A, 6B, 6C, 6D, 6E, 6F, 6G, 6H, 6I, 6J:
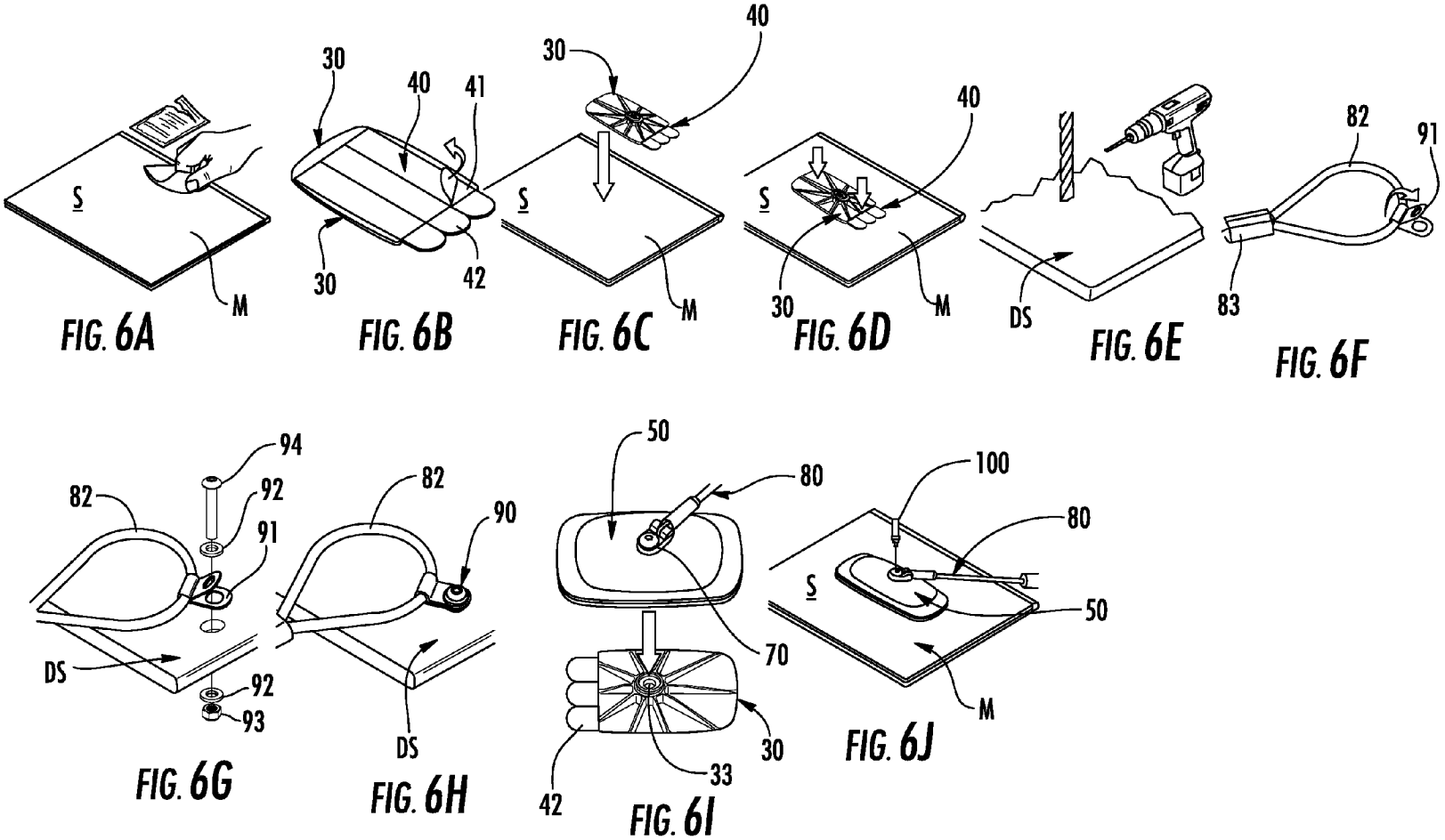
FIGS. 6A-6J are series perspective views illustrating an exemplary embodiment of a second method for displaying and protecting an article of merchandise using the merchandise display security tether of FIG. 1.

The series perspective views FIGS. 6A-6J illustrate an exemplary embodiment of a second method for displaying and protecting an article of merchandise using the merchandise display security tether assembly of FIG. 1. In the illustrated embodiment, the anchor assembly 90 of the merchandise display security tether 20 previously described is utilized to attach the security cable 80, and consequently, the article of merchandise M to a display surface DS, such as a tabletop, shelf or counter of a display. As shown in FIG. 6A, a relatively flat surface S of an article of merchandise M, for example the display screen of the laptop computer shown in FIG. 4, is first prepared for receiving the adhesive strip assembly 40 by cleaning the surface with an alcohol pad. As previously described, one side of the adhesive strip assembly 40 is pressed into firm engagement with the first surface 31 of mounting base 30. As shown in FIG. 6B, release paper covering the PSA strips 41 is then removed to expose the adhesive on the other side of the strips so that the combination mounting base 30 and adhesive strip assembly 40 may be firmly pressed against the surface S of the article of merchandise M at a desired location in the manner illustrated in FIGS. 6C and 6D. As shown in FIG. 6E, a suitably sized hole is then drilled through the display surface DS at a desired location. Housing 50 is connected to the security cable 80 as previously described and the Adel clamp 91 of the anchor assembly 90 is positioned around the cable loop 82 of the security cable 80 as illustrated in FIG. 6F. The special tool having a proprietary shaped tip 100 is used to engage the tamper-proof security fastener 94 and thereby secure the Adel clamp 91 to the display surface DS in the manner shown in FIGS. 6G and 6H. As illustrated in FIGS. 6I and 6J, housing 50 is next positioned over the mounting base 30 affixed to the surface S of the merchandise M to simultaneously cover the combination mounting base 30 and adhesive strip assembly 40. The special tool having proprietary shaped tip 100 is used to engage the tamper-proof security fastener 70 and thereby secure housing 50 to the threaded insert 33 of the mounting base 30. The article of merchandise M may then be positioned in the desired display orientation to be examined and operated by a customer. As previously mentioned, security fastener 70 prevents an unauthorized person from removing the housing 50 from mounting base 30 and thereby gaining access to the releasing tabs 42 (FIG. 6I) of PSA strips 41. At the same time, security fastener 70 permits an authorized person to remove the housing 50 from the mounting base 30 for the purpose of relocating the article of merchandise M to another security cable 80 and housing 50 elsewhere on the display without the need to detach the merchandise from the mounting base.

Figure 7C:
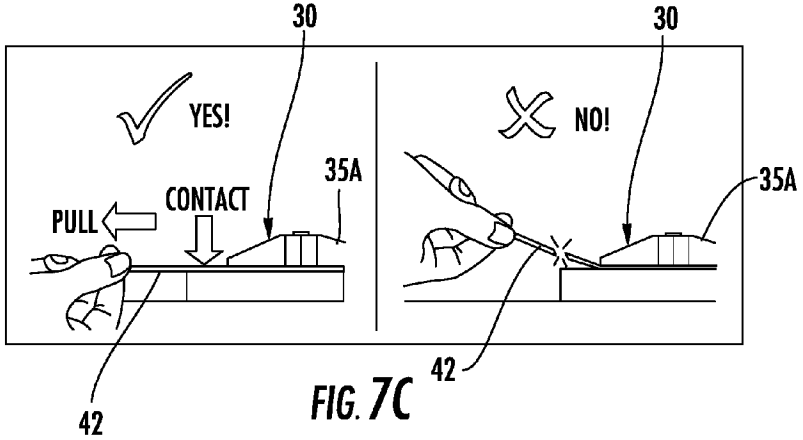
FIGS. 7A-7D are series perspective views illustrating an exemplary embodiment of a method for removing the mounting base and adhesive strip assembly of the merchandise display security tether of FIG. 1 from an article of merchandise.
Figure 7B:
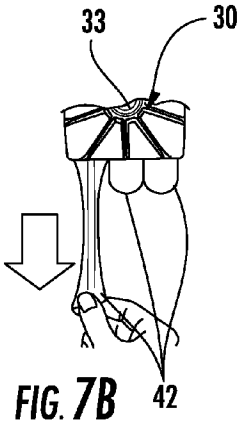
Figure 7A:
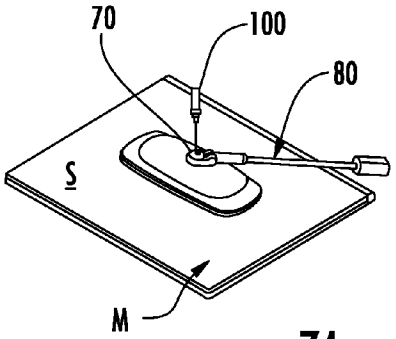
Figure 7D:
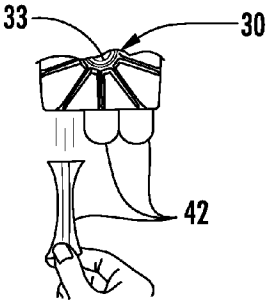

The series perspective views FIGS. 7A-7D illustrate an exemplary embodiment of a method for removing the combination mounting base and adhesive strip assembly of the merchandise display security tether of FIG. 1 from an article of merchandise. When it is desired for an authorized person to detach the combination mounting base 30 and adhesive strip assembly 40 from the surface S of the article of merchandise M, housing 50 is first removed as shown in FIG. 7A by using the special tool having proprietary shaped tip 100 to disengage tamper-proof security fastener 70 from the threaded insert 33 of the mounting base 30. Once the housing 50 is removed and the combination mounting base 30 and adhesive strip assembly 40 is accessible, each of the releasing tabs 42 of the PSA strips 41 is sequentially grasped and pulled slowly away from the mounting base 30 in a longitudinal direction substantially parallel to the surface S of the article of merchandise M and the first surface 31 of the mounting base 30 in the manner illustrated in FIG. 7B. As shown in FIG. 7C, the tab 42 of each PSA strip 41 is preferably pulled in a direction perpendicular to the adhesive contact force between the surface S of the article of merchandise M and the PSA strip since pulling the tab at an angle to the surface of the merchandise may cause the tab to tear and separate. As illustrated in FIG. 7D, pulling the tab 42 of the PSA strip 41 in the manner described herein simultaneously releases the PSA strip of the adhesive strip assembly 40 from the surface S of the article of merchandise M and from the first surface 31 of the mounting base 30. As a result, the releasing tabs 42 of the PSA strips 41 permit an authorized person to readily (i.e. quickly and easily) remove the combination mounting base 30 and adhesive strip assembly 40 of the merchandise display security tether 20 from the surface S of the article of merchandise M without causing damage to the merchandise and without leaving an adhesive residue on the merchandise that requires subsequent cleaning.

The foregoing has described one or more exemplary embodiments of a merchandise display security tether for displaying and protecting an article of merchandise. The merchandise display security tether includes a releasable adhesive so that an authorized person can readily remove the merchandise display security tether from the article of merchandise without causing damage to the merchandise and without leaving an adhesive residue on the merchandise that requires subsequent cleaning. Exemplary embodiments of a merchandise display security tether including a releasable adhesive have been shown and described herein for purposes of illustrating and enabling the best mode of the invention. Those of ordinary skill in the art will understand and appreciate that numerous variations and modifications of the invention may be made without departing from the spirit and scope of the invention. Accordingly, all such variations and modifications are intended to be encompassed by the appended claims.

That which is claimed is:

1. A merchandise display security device for displaying and protecting an article of merchandise from theft, the security device comprising:

a mounting base;

a releasable adhesive for releasably attaching the mounting base to the article of merchandise;

a housing configured to be secured to the mounting base and to prevent access to at least a releasing portion of the releasable adhesive; and a security cable having a first end attached to the housing and having a second end configured to be secured to a merchandise display.

2. The security device of claim 1, wherein the releasable adhesive comprises a pressure sensitive adhesive (PSA) strip having a first side adapted to be adhered to the mounting base and a second side adapted to be releasably adhered to the article of merchandise.

3. The security device of claim 2, wherein the second side of the pressure sensitive adhesive (PSA) strip is releasably adhered to the article of merchandise such that the article of merchandise is removable from the mounting base without damaging the article of merchandise and without leaving an adhesive residue on the article of merchandise.

4. The security device of claim 1, wherein the housing is positioned over the mounting base and the releasing portion of the releasable adhesive, and wherein the housing is secured to the mounting base by a tamper-proof fastener.

5. The security device of claim 4, wherein the mounting base has a threaded insert and wherein the tamper-proof fastener engages the threaded insert to secure the housing to the mounting base.

6. The security device of claim 1, wherein the first end of the security cable is movably attached to the housing such that the article of merchandise is movable relative to the security cable.

7. The security device of claim 1, wherein the security cable comprises a cable loop at the second end such that the security cable can be looped around a bar and the housing passed through the cable loop to secure the article of merchandise to the merchandise display.

8. The security device of claim 1, wherein the releasing portion of the releasable adhesive is free of adhesive.

9. The security device of claim 1, wherein the housing is configured to extend over the mounting base to cover, and prevent access to, the releasable adhesive.

10. The security device of claim 1, wherein the releasable adhesive comprises a plurality of pressure sensitive adhesive (PSA) strips.

11. The security device of claim 1, wherein the releasing portion is only accessible for removing the releasable adhesive when the housing is unsecured.

12. The security device of claim 1, wherein the security cable comprises an anchor assembly at the second end such that the security cable can be anchored to a display surface to secure the article of merchandise to the merchandise display.

13. The security device of claim 12, wherein the anchor assembly comprises a tamper-proof fastener for anchoring the second end of the security cable to the merchandise display.

14. A method of displaying and protecting an article of merchandise from theft, the method comprising:

providing a merchandise display security device comprising a mounting base, a releasable adhesive for releasably adhering the mounting base to the article of merchandise, and a housing configured to prevent access to a releasing portion of the releasable adhesive;

adhering one side of the releasable adhesive to a first surface of the mounting base;

adhering the other side of the releasable adhesive to the article of merchandise;

attaching a first end of a security cable to the housing and securing a second end of the security cable to a merchandise display;

positioning the housing over the mounting base and the releasing portion of the releasable adhesive; and attaching the housing to the mounting base to prevent access to the releasing portion of the releasable adhesive without detaching the housing from the mounting base.

15. The method of claim 14, wherein securing a second end of the security cable to a merchandise display comprises:

providing a cable loop at the second end of the security cable;

looping the security cable around a bar of the merchandise display; and passing the housing through the cable loop to secure the article of merchandise to the merchandise display with the housing secured to the mounting base.

16. The method of claim 15, further comprising:

detaching the housing from the mounting base to expose the releasing portion of the releasable adhesive; and pulling the releasing portion of the releasable adhesive to release the mounting base and the article of merchandise without causing damage to the article of merchandise and without leaving an adhesive residue on the article of merchandise.

17. The method of claim 16, wherein detaching the housing from the mounting base comprises removing a tamper-proof fastener from the mounting base.

18. The method of claim 13, wherein securing a second end of the security cable to a merchandise display comprises:

providing an anchor assembly at the second end of the security cable, the anchor assembly comprising a tamper-proof fastener; and anchoring the second end of the security cable to the merchandise display using the tamper-proof fastener to prevent the article of merchandise being removed from the merchandise display.

19. The method of claim 18, further comprising:

detaching the housing from the mounting base to expose the releasing portion of the releasable adhesive; and pulling the releasing portion of the releasable adhesive to release the mounting base and the article of merchandise without causing damage to the article of merchandise and without leaving an adhesive residue on the article of merchandise.

20. The method of claim 19, wherein detaching the housing from the mounting base comprises removing a tamper-proof fastener from the mounting base.

21. A merchandise display security tether for displaying and protecting an article of merchandise from theft, the security tether comprising:

a mounting base;

a releasable adhesive for releasably attaching the mounting base to the article of merchandise;

a housing configured to be positioned over the mounting base and a releasing portion of the releasable adhesive, the housing being removably secured to the mounting base so as to prevent access to the releasing portion of the releasable adhesive; and a security cable having a first end attached to the housing and a second end configured for attachment to a merchandise display;

wherein the releasing portion of the releasable adhesive permits the article of merchandise to be detached from the mounting base.

22. The security tether of claim 21, wherein the releasable adhesive comprises a pressure sensitive adhesive (PSA) strip and wherein the releasing portion of the releasable adhesive comprises a releasing tab at an end of the pressure sensitive adhesive (PSA) strip that is configured to be pulled to detach the article of merchandise from the mounting base without damage to the article of merchandise and without leaving an adhesive reside on the article of merchandise.

23. A merchandise display security device for displaying and protecting an article of merchandise from theft, the security device comprising:

a mounting base;

a releasable adhesive for releasably attaching to the mounting base;

a housing configured to be secured to the mounting base and to prevent access to at least a releasing portion of the releasable adhesive; and a cable configured to be attached to the housing for securing the article of merchandise.

24. The security device of claim 23, wherein the cable comprises a first end configured to engage the housing.

25. The security device of claim 24, wherein the cable comprises a second end having a loop.

26. The security device of claim 24, wherein the cable comprises a second end configured to be secured to a merchandise display.

27. The security device of claim 24, wherein the first end is releasably engaged with the housing.

28. The security device of claim 23, wherein the releasable adhesive is configured to be releasably attached to the article of merchandise.

* * * * *

UNITED STATES PATENT AND TRADEMARK OFFICE

CERTIFICATE OF CORRECTION

PATENT NO. : 9,103,142 B2
APPLICATION NO. : 13/401008
DATED : August 11, 2015
INVENTOR(S) : Abdollahzadeh et al.

It is certified that error appears in the above-identified patent and that said Letters Patent is hereby corrected as shown below:

IN THE CLAIMS

Column 9, line 15, Claim 18 delete "13" and insert --14--.

Signed and Sealed this
Twenty-second Day of December, 2015

Michelle K. Lee

Michelle K. Lee
*Director of the United States Patent and Trademark Office*